United States Patent [19]

DeBenedictis et al.

[11] 4,260,982

[45] Apr. 7, 1981

[54] PULSE CODE MODULATION RESPONSIVE ALARM SYSTEM

[76] Inventors: Angelo P. DeBenedictis, 54 Carleton Rd., Carlisle, Mass. 01741; Plato Zorzy, P.O. Box 2074, Salem, Mass. 01970

[21] Appl. No.: 88,034

[22] Filed: Oct. 25, 1979

[51] Int. Cl.[3] ..... G08B 3/10

[52] U.S. Cl. ..... 340/539; 340/63; 340/568; 340/695; 455/26

[58] Field of Search ..... 340/32, 52 R, 53, 56, 340/63, 539, 568, 673, 695; 455/26

[56] References Cited

U.S. PATENT DOCUMENTS

| | | | |
|---|---|---|---|
| 3,157,871 | 11/1964 | Umanoff | 340/539 |
| 4,013,994 | 3/1977 | Ragano et al. | 340/539 |

*Primary Examiner*—Alvin H. Waring

*Attorney, Agent, or Firm*—Pearson & Pearson

[57] ABSTRACT

A system for producing an alarm whenever the distance between a transmitter and a receiver exceeds a predetermined distance. The transmitter includes circuitry for generating a signal having a preselected pulse code modulation pattern. The receiver includes circuitry for responding to the particular pulse code pattern and for sounding an alarm when the signal from the transmitter is so weak that pattern is not received.

10 Claims, 4 Drawing Figures

PULSE CODE MODULATION RESPONSIVE ALARM SYSTEM

BACKGROUND OF THE INVENTION

This invention generally relates to signalling devices. More specifically, it relates to a signalling device that produces an alarm whenever the distance between a transmitter and a receiver exceeds a predetermined distance.

There are a number of applications for such signalling devices. For example, a person in the confusion of travelling might leave luggage in a terminal. It would be helpful to alert the person that his luggage has been left so he could avoid the inconvenience of lost luggage. Examples of other applications include alerting a parent if a child were to wander from some predetermined area, or permitting a pet owner to monitor the whereabouts of a pet.

There are several prior anti-theft devices that typically include a transmitter and a receiver. The receiver measures the amplitude of the incoming signal and sounds an alarm when the amplitude falls below a predetermined level. In these applications, however, the receiver and alarm are placed on an article, such as an automotive vehicle, that is being protected so that the alarm sounds if the vehicle is driven more than a predetermined distance from a central location, such as a garage, without disabling the receiver.

Even where the transmitter is located on the person or article being monitored or if the foregoing anti-theft devices were offered with installation of the transmitter on the person or article being monitored, the resulting system would still be prone to interference from spurious signals. More specifically, when the alarm is sensitive only to the amplitude of a detected signal an interfering signal could cause the detection circuitry to falsely sense the presence of the transmitted signal.

SUMMARY OF THE INVENTION

Therefore, it is an object of this invention to provide an improved signalling device for alerting a person at a central location that a person, pet, or article at a remote location has moved beyond a predetermined distance from the central location.

Still another object of this invention is to provide such a signalling device which is essentially insensitive to inteferring signals.

Still another object of this invention is to provide such a signalling device that is easy to use.

Still another object of this invention is to provide such a signalling device which also informs the person who is monitoring that the system is operating improperly.

In accordance with this invention, a transmitter is affixed to the person, animal or article being monitored. The transmitter produces a pulse code modulated signal. The person monitoring has a receiver which detects the presence of a signal having only the pulse code characteristics of the transmitted signal. As the transmitter is displaced from the receiver, the amplitude of the received signal is measured. As the distance increases beyond a predetermined distance, the receiver sounds an alarm.

This invention is pointed out with particularity in the appended claims. The above and further objects and advantages of this invention may be better understood by referring to the following detailed description taken in conjuction with the accompanying drawings.

DESCRIPTION OF AN ILLUSTRATIVE EMBODIMENT

Figure 1:
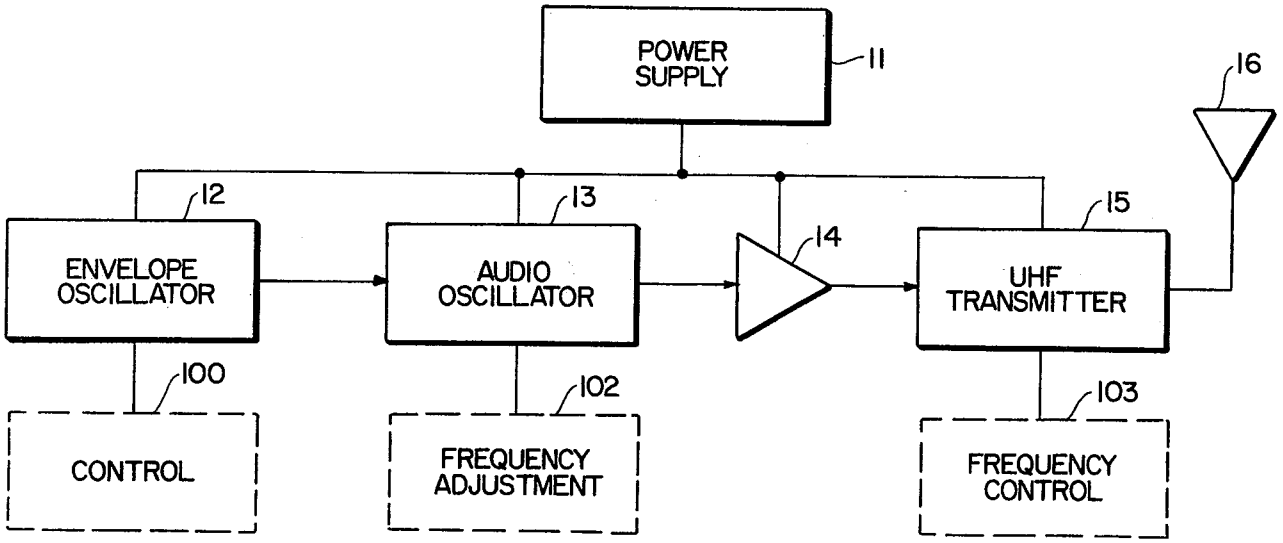
FIG. 1 is a generalized block diagram of a transmitter constructed in accordance with this invention.

The transmitter 10 shown in FIG. 1 comprises several conventional elements. They include a self-contained power supply 11 that energizes all the other elements in the transmitter. Typically the power supply will include a minature battery and may include voltage regulating circuitry.

Figure 2:
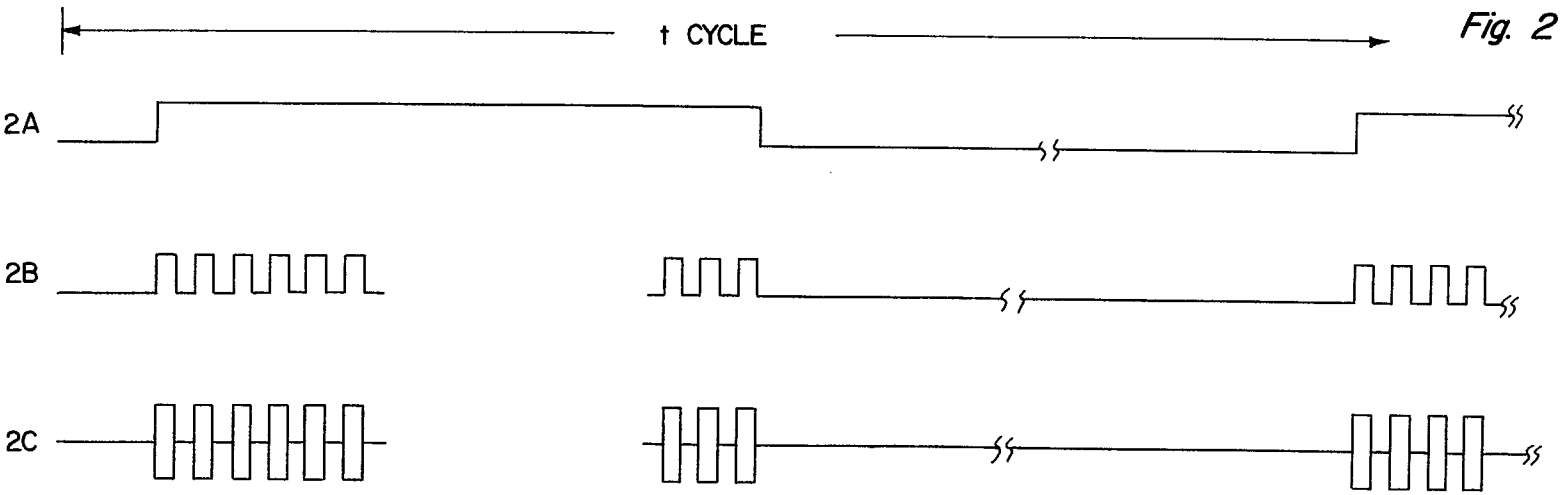
FIG. 2 is a diagram of various signals that appear in the transmitter and receiver.

An envelope oscillator 12 controls the modulation of an audio oscillator 13. In a simple embodiment, the envelope oscillator produces an output signal that is shown in FIG. 2A. As one example, the circuit produces a two-millisecond pulse each two hundred milliseconds. Thus, a sequence of pulses from the envelope oscillator 12 is characterized as a low frequency pulse train (e.g., five Hz) in which the pulses have a very short duty cycle (e.g., one percent ).

This pulse train turns the audio oscillator 13 on and off. Thus, the audio oscillator produces a burst of audio signals having a duration corresponding to the duration of the signal from the envelope oscillator. In response to the specific pulse train discussed above, the audio oscillator produces a burst of pulses for a two millisecond duration. In one specific embodiment, the audio oscillator 13 produces a twenty kilohertz signal, so the burst comprises forty pulses.

The signals from the oscillator 13 pass through an amplifier 14, and the amplified signals modulate a UHF transmitter 15 thereby to produce a series of high-frequency pulses that are radiated into space by an antenna 16. Thus, the UHF transmitter produces a series of forty bursts of UHF energy (typically 300 MHz) during each time the envelope oscillator 12 turns on the audio oscillator 13. This is a pulse code modulated, constant frequency signal that is radiated into space.

Figure 3:
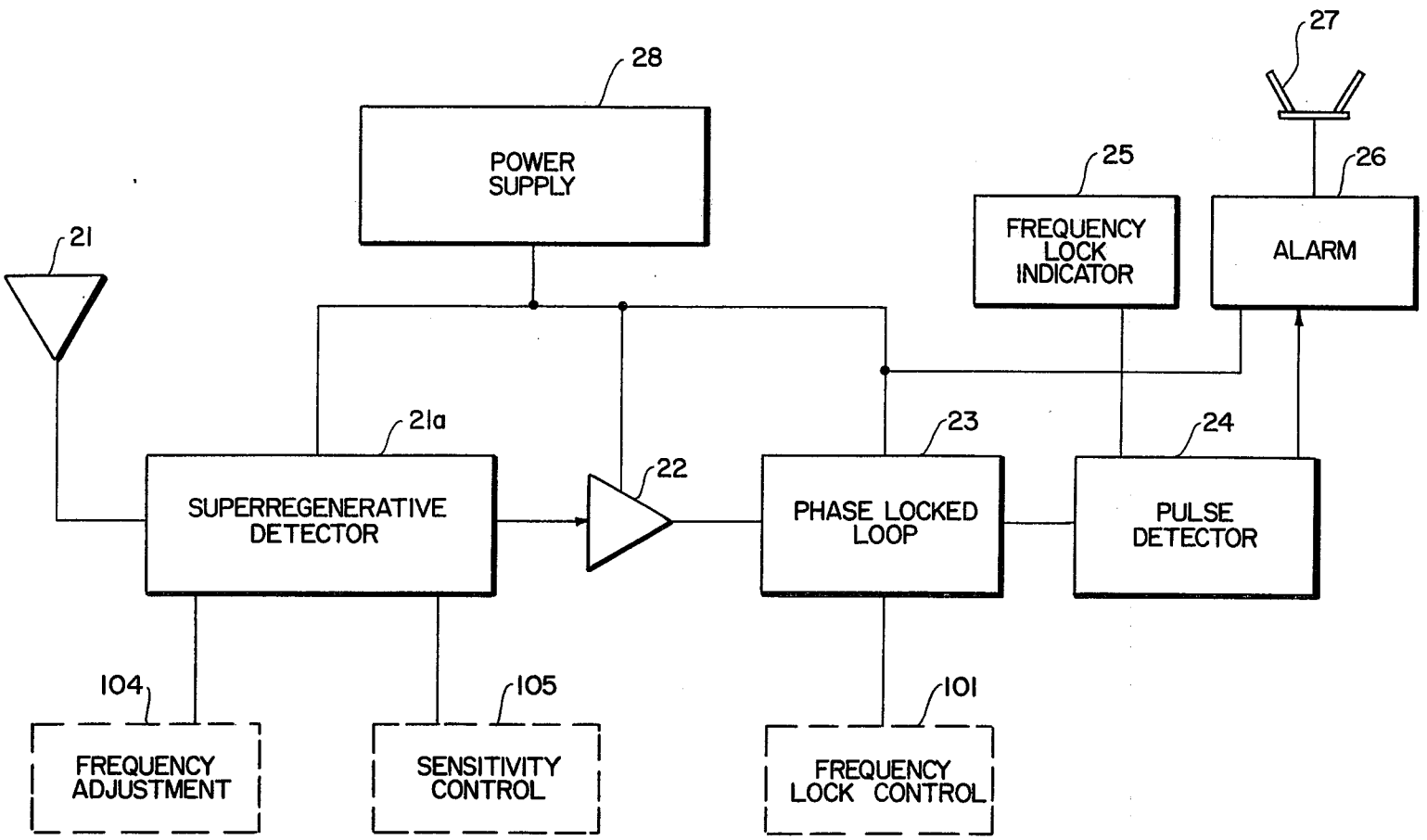
FIG. 3 is a generalized block diagram of a receiver used in the signalling system of this invention.

Now referring to FIG. 3, the receiver 20 also comprises several conventional elements including an antenna 21 that receives the signals shown in FIG. 2C and conveys them to a conventional receiving circuit 21*a*. The receiving circuit 21*a* demodulates the incoming signal and produces a signal corresponding to that shown in FIG. 2B at the input of an amplifier 22. A phase locked loop circuit 23 receives the output from the amplifier 22 and produces an output signal corresponding to that shown in FIG. 2A whenever the transmitter is turned on. These pulses are then transferred to a pulse detector circuit 24. As long as the pulses from the phase locked loop 23 exceed a predetermined threshold, the pulse detector 24 energizes a frequency lock detector 25. The detector 25 thereby notifies the person that the system is operating and that the transmitter is within a predetermined range. Typically this could comprise a visual indication, such as a light-emitting diode.

In addition, the pulse detector 24 also controls an alarm circuit 26. When the energy in the pulse train from the phase locked loop 23 drops below the predetermined threshold, the pulse detector energizes the alarm circuit thereby to produce an indication that the transmitter has moved beyond a predetermined range from the receiver. Typically, this will be an audio signal produced by a speaker 27 or similar device. A conventional power supply 28 provides power to the receiver.

In accordance with some of the objects of this invention, the foregoing circuitry provides a signalling device which is less sensitive to noise because the phase locked loop and detector, or similar circuitry, provides a second test on the incoming signal. An interfering signal would have to exactly match the transmitted signal in order to overcome this additional requirement of the signal. Thus, the transmitter is less likely to move beyond the predetermined range without an indication. Secondly, the frequency lock detector 25 shown in FIG. 3 provides a positive indication that the transmitter is within the predetermined range.

Figure 4:
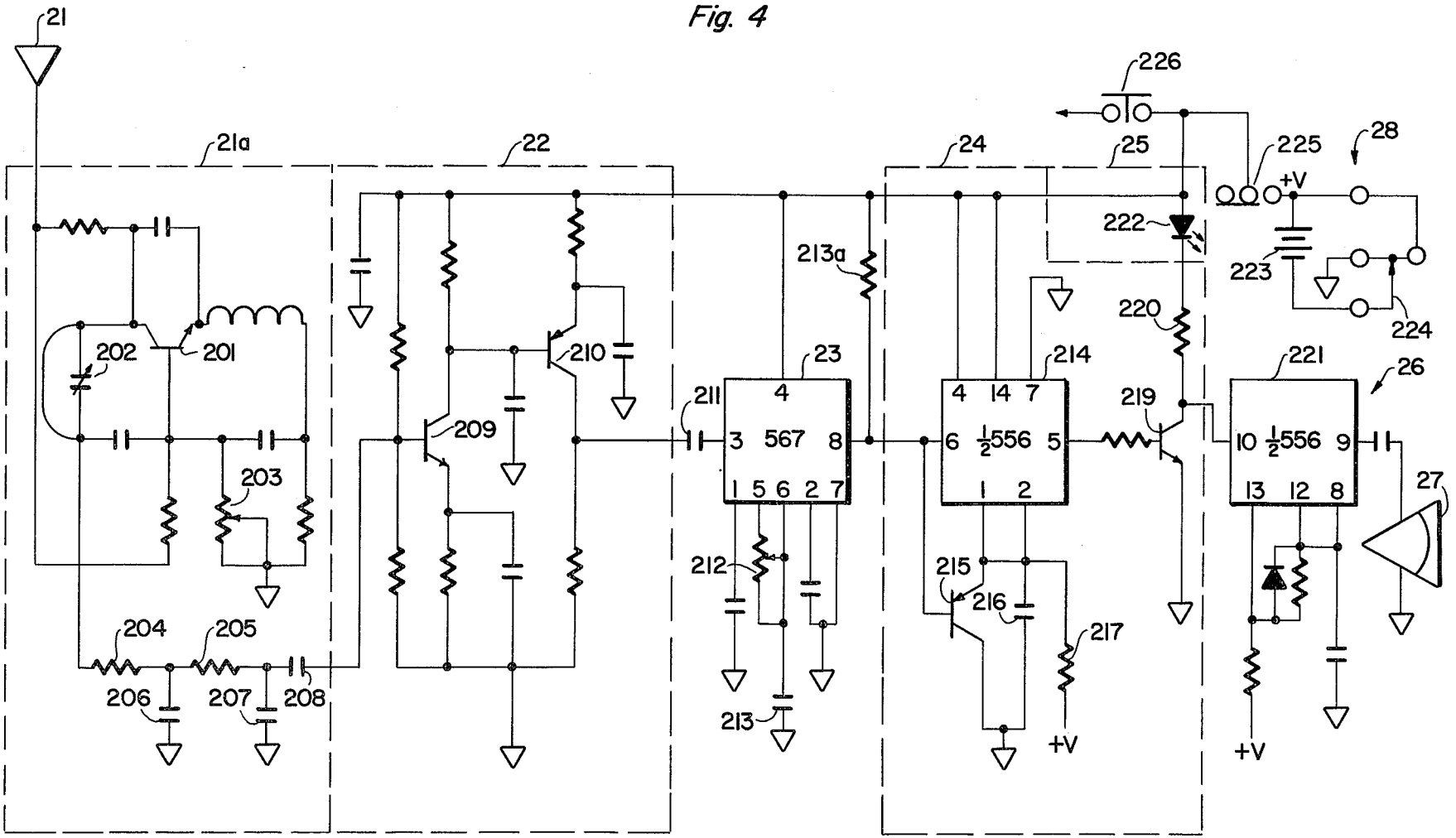
FIG. 4 is a detailed diagram of the receiver shown in FIG. 3.

FIG. 4 depicts a detailed schematic diagram of a receiver useful with the invention. Receiving antenna 21 senses the transmitted signal. The antenna signal is fed to the base of the transistor 201 in the superegenerative detector 21. The detector includes a variable capacitor 202 for tuning and a variable resistor 203 for adjusting the sensitivity of the detector. The detector also includes resistors 204 and 205 and capacitors 206, 207 and 208 that form a bandpass filter to pass signals within a preselected range. In this specific embodiment where the frequency of the desired incoming signal is 20 khz, the filter bandpass range is 1 khz–30 khz. The filter rejects any signals above 30 khz and below 1 khz.

The output of the bandpass filter, taken from capacitor 208, is fed to a conventional two-stage audio amplifier 22. The amplifier includes transistors 209 and 210, and resistors and capacitors connected to the transistors in conventional biasing and filtering circuits.

The output signal of audio amplifier 22, taken from the collector of transistor 210, represents the pulse code modulation signal portion of the signal received at the antenna 21. This output signal is fed through capacitor 211 to the phase locked loop circuit 23. The phase locked loop is a conventional circuit available as an integrated circuit, and therefore the circuit is not set forth herein in detail. An example of a suitable integrated circuit is number SE 567, available from Signetics Corporation. A frequency lock control comprising variable resistor 212 and a capacitor 213 is connected to the phase locked loop circuit to adjust the center frequency of the phase locked loop. A pull-up resistor **213*a* is connected to the output of the phase locked loop. When a signal of the proper frequency is sensed by the phase locked loop, the output is a downward going pulse similar to the pulse train shown in FIG. 2B**.

The pulse detector 24 comprises an integrated circuit 214 having the connections shown in FIG. 4. A suitable integrated circuit is a type 555 timer that comprises onehalf of a 556 integrated circuit. The output from the phase locked loop is connected to the trigger input of the timer and also is connected to the base of a transistor 215. The emitter of the transistor is connected to timing inputs of the integrated circuit 214 and to a capacitor 216. The other side of the capacitor is connected to the collector of transistor 215 and to ground. The emitter is also connected to one side of a resistor 217, the other side of which is connected to the positive voltage from the power supply 28.

The negative going output pulse from phase locked loop 23 continually resets timer 214. The pulses also turn on transistor 215, which keeps the voltage from building up across capacitor 216. Between pulses, the capacitor 216 charges to a voltage determined by the RC time constant of resistor 217 and capacitor 216. At the next input pulse from the phase locked loop 23, the transistor discharges the capacitor 216. If a pulse is missed, the output from the phase locked loop, through the pull-up resistor, remains high. The capacitor 216 continues charging and the timer 214 is not reset. Eventually, the charge on the capacitor increases and the timer is triggered. When the timer is triggered, the output goes low. The output of the timer is connected through a resistor 218 to the base of a normally-conducting transistor 219. When the output of timer 214 goes low, transistor 219 stops conducting. Pull up resistor 220 pulls up the voltage at the collector of transistor 219, and the signal at the collector may be considered a presence detected signal because it is at a low level, or ground assertion level, when the incoming signal satisfies both tests. However, when the presence detected signal shifts to a high output it triggers a tone generator 221, which may be a second type 555 integrated circuit connected, conventionally, as a tone burst generator 221. The output of tone generator 221 is fed to a speaker 27 that broadcasts the alarm tone response. Thus, the alarm circuit 26 generates an alarm signal in response to the logical absence of the presence detected signal.

The receiver also includes a frequency lock indicator 25 comprising a light emitting diode 222 connected in the collector circuit of transistor 219. When the transistor is conducting, as when a signal is being received by the receiver, the diode emits light. When the signal is lost, the transistor is turned off and the LED goes dark.

The power supply 28 comprises a battery 223 and a power jack 204 that can be connected to an external power or battery recharger. An on-off switch 225 is connected between the power supply and the receiver. A test switch 226 may also be provided to connect between the power supply and antenna input 21 to test the circuit.

There are a number of phantom blocks shown in FIGS. 1 and 3 to provide other controls on the system. For example, a control circuit 100 might be added to the envelope oscillator 12 thereby to alter the signal shown in FIG. 2A and to encode even that signal. The addition of such a control might require the further addition of a frequency lock control circuit 101 and modification of the pulse detector 24 shown in FIG. 3.

As the phase locked loop 23 responds to the signals from the audio-oscillator 13, it is possible for the receiver to respond to another oscillator having the same frequency. Thus, the transmitter could include a frequency adjustment circuit 102 to alter those signals; this would require the addition of other circuitry in the frequency lock control circuit. Similarly different UHF frequencies might be used and be attained by adding to the transmitter a frequency control 103 and a frequency adjustment circuit 104.

The foregoing description is limited to a specific embodiment of this invention. It will be apparent, however, that this invention can be practiced in systems having different internal circuitry than is described in this specification with the attainment of some or all of the foregoing objects and advantages of this invention.

For example, the two type 555 integrated circuits can be substituted by a single type 556 integrated circuit, which contains the two circuits comprising each of the type 555 integrated circuits. Therefore, it is the object of the appended claims to cover all such variations and modifications as come within the true spirit and scope of this invention.

What is claimed as new and desired to be secured by Letters Patent of the United States is:

1. A system for detecting the displacement of two objects comprising:

A. a transmitter associated with one object, said transmitter including;

(i) power supply means;

(ii) means connected to said power supply means for generating a constant frequency signal having a preselected pattern of pulse code modulation; and (iii) antenna means connected to said generating means for radiating said constant frequency pulse code modulated signal; and B. a receiver associated with the second object, said receiver including:

(i) receiving means for receiving the pulse code modulated, constant frequency signal and for detecting the pulse code modulation signal portion thereof;

(ii) presence detecting means connected to said receiving for generating a presence detected signal in response to the presence of a constant frequency signal characterized by the pulse code modulation pattern;

(iii) alarm means connected to the presence detecting means for generating an alarm signal in response to the absence of a presence detected signal.

2. A system as defined in claim 1 wherein the presence detecting means comprises a phase locked loop detector.

3. A system as defined in claim 1 wherein the alarm signal generating means includes:

(i) oscillator means connected to the presence detecting means for generating an electrical signal in response to the absence of the presence detected signal; and (ii) transducer means connected to said oscillator means for generating an alarm in response to the electrical signal from said oscillator means.

4. A system as defined in claim 3 further including means connected to said presence detecting means for generating an indication when said presence detecting means asserts the presence detected signal.

5. A system as defined in claim 4 wherein said indicating means constitutes a light emitting diode.

6. A system for detecting the displacement of two objects comprising:

A. a transmitter associated with one object, said transmitter including:

(i) power supply means;

(ii) means connected to said power supply means for generating a constant frequency signal having a preselected pattern of pulse code modulation, said means including:

(a) means for generating a pulse code envelope signal, (b) means connected to the envelope signal generating means for generating a pulsed audio frequency signal modulated by the envelope signal, and (c) means connected to the pulsed audio frequency signal generating means for generating a radio frequency signal modulated by the pulsed audio frequency signal, (iii) antenna means connected to said generating means for radiating said constant frequency pulse code modulated signal; and B. a receiver associated with the second object, said receiver including;

(i) receiving means for receiving the pulse code modulated, constant frequency signal and for detecting the pulse code modulation signal portion thereof;

(ii) presence detecting means connected to said receiving means for generating a presence detected signal in response to the presence of a constant frequency signal characterized by the pulse code modulation pattern;

(iii) alarm means connected to the presence detecting means for generating an alarm signal in response to the absence of a presence detected signal.

7. A system as defined in claim 6 wherein the presence detecting means comprises a phase locked loop detector.

8. A system as defined in claim 6 wherein the alarm signal generating means includes:

(i) oscillator means connected to the presence detecting means for generating an electrical signal in response to the absence of the presence detected signal; and (ii) transducer means connected to said oscillator means for generating an alarm in response to the electrical signal from said oscillator means.

9. A system as defined in claim 8 further including means connected to said presence detecting means for generating an indication when said presence detecting means asserts the presence detected signal.

10. A system as defined in claim 9 wherein said indicating means constitutes a light emitting diode.

* * * * *